United States Patent [19]

Johnson

[11] Patent Number: 5,025,517

[45] Date of Patent: Jun. 25, 1991

[54] COLLAPSIBLE STRUCTURE SUITABLE FOR USE AS A PORTABLE PLAY YARD

[75] Inventor: Edward Johnson, Park Forest, Ill.

[73] Assignee: Kolcraft Enterprises, Inc., Chicago, Ill.

[21] Appl. No.: 448,856

[22] Filed: Dec. 12, 1989

[51] Int. Cl.[5] ..... A47D 7/00

[52] U.S. Cl. ..... 5/99.1; 5/98.1

[58] Field of Search ..... 5/98 R, 99 R, 99 A, 5/99 C; 190/2

[56] References Cited

U.S. PATENT DOCUMENTS

| | | | |
|---|---|---|---|
| 2,493,083 | 1/1950 | Pascoo | 5/99 C |
| 3,296,633 | 1/1967 | Rieger | 5/99 R |
| 3,800,341 | 4/1974 | Davanzo | 5/99 R |
| 4,483,026 | 11/1984 | Kassai | 5/99 R |
| 4,692,953 | 9/1987 | Fetters | 5/99 A |
| 4,934,025 | 6/1990 | Mariol | 5/99.1 X |

*Primary Examiner*—Michael F. Trettel

*Attorney, Agent, or Firm*—Staas & Halsey

[57] ABSTRACT

A collaphible structure suitable for use as a childrens' play yard. The collapsible structure includes opposing end members movably connected by articulated elongated members. By rotating the articulated elongated members, the elongated members can be folded to bring the end members into juxtaposition; thus, encasing a base, side walls and the elongated members of the play yard.

2 Claims, 4 Drawing Sheets

FIG. 2
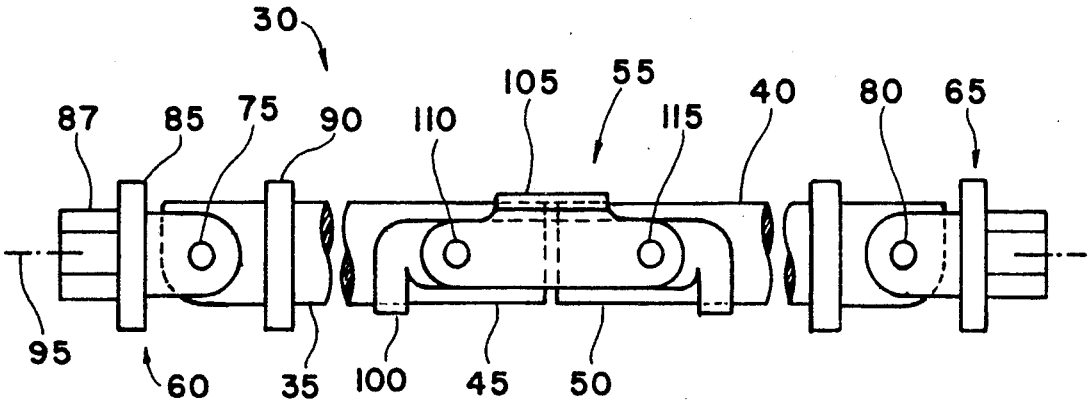
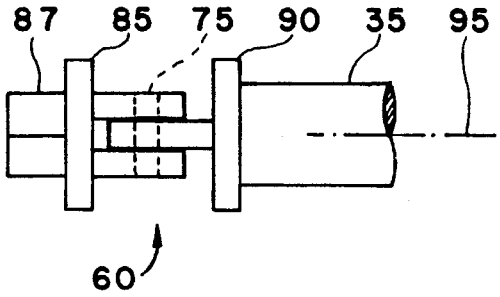
FIG. 3
FIG. 4
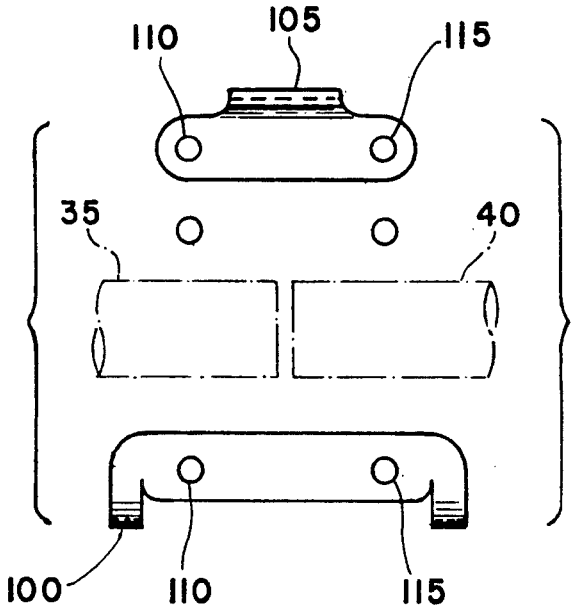

COLLAPSIBLE STRUCTURE SUITABLE FOR USE AS A PORTABLE PLAY YARD

BACKGROUND OF THE INVENTION

The present invention relates to collapsible or foldable structures; and more particularly, to a collapsible structure suitable for use as a portable play yard. Childrens' portable play yards, while convenient, are typically bulky or awkward structures that are difficult to fold and transport. These difficulties are due, in part, to the difficulty of collapsing or folding the play yard structural members into a package than can be easily transported and stored.

SUMMARY OF THE INVENTION

It is an object of the present invention to provide a collapsible structure suitable for use as a portable play yard.

It is another object of the present invention to provide a collapsible structure comprising a small number of parts connected in a simple and efficient manner.

It is still another object of the present invention to provide a collapsible structure that is easy to fold and transport.

It is a further object of the present invention to provide a collapsible structure that collapses to a convenient package.

It is still a further object of the present invention to provide a collapsible structure wherein end portions of the play yard encase play yard when folded.

To achieve the above and other objects, the present invention provides a pair of opposing end members; a coupling member coupled between the end members and having a deployed position and a collapsible position; and a movable member coupled to the coupling member such that the coupling member changes between the deployed and collapsible positions in response to movement of the movable member.

The present invention also provides a collapsible structure including end members that are movable between a first position wherein the end members are in spaced apart opposition and a second position wherein the end members are juxtaposed; a base positioned between the end members; a coupling member movable between a deployed position when the end members are in the first position and a folded position when the end members are juxtaposed so as to house the end members, the base and the coupling members, and movable between the deployed position and a collapsible position; and a movable member connected to the coupling member such that movement of the movable member causes the coupling member to move between the deployed and collapsible positions.

The present invention further provides a collapsible structure comprising first and second wall members, a base positioned between the wall members, side walls positioned between the wall members, and support means for holding the wall members in spaced apart opposition in a first state, and for enabling juxtaposition of the wall members such that the wall members encase the bottom and the side walls in a second state.

The present invention further provides a collapsible structure comprising a housing that includes first and second halves and a integral handle portion; a foldable base that is movably connected between the first and second halves; flexible side panels that are operatively connected between the first and second halves; a pair of selectively articulated coupling members that are movably connected between the first and second halves so as to hold the first and second halves in spaced apart opposition when the coupling members are in a first position, and to permit the first and second halves to house the foldable base, the flexible side panels and the coupling members when the coupling members are in second position; and a pair of movable members that are respectively connected to corresponding ones of the coupling members so that movement of the movable members causes the corresponding coupling members to move between the first and second positions.

BRIEF DESCRIPTION OF THE DRAWINGS

FIG. 2 is a side view of a portion of the FIG. 1 embodiment;

FIG. 3 is a top view of an end portion shown in FIG. 2;

FIG. 4 is a exploded side view of a hinge shown in FIG. 2;

DESCRIPTION OF THE PREFERRED EMBODIMENTS

Figure 1:
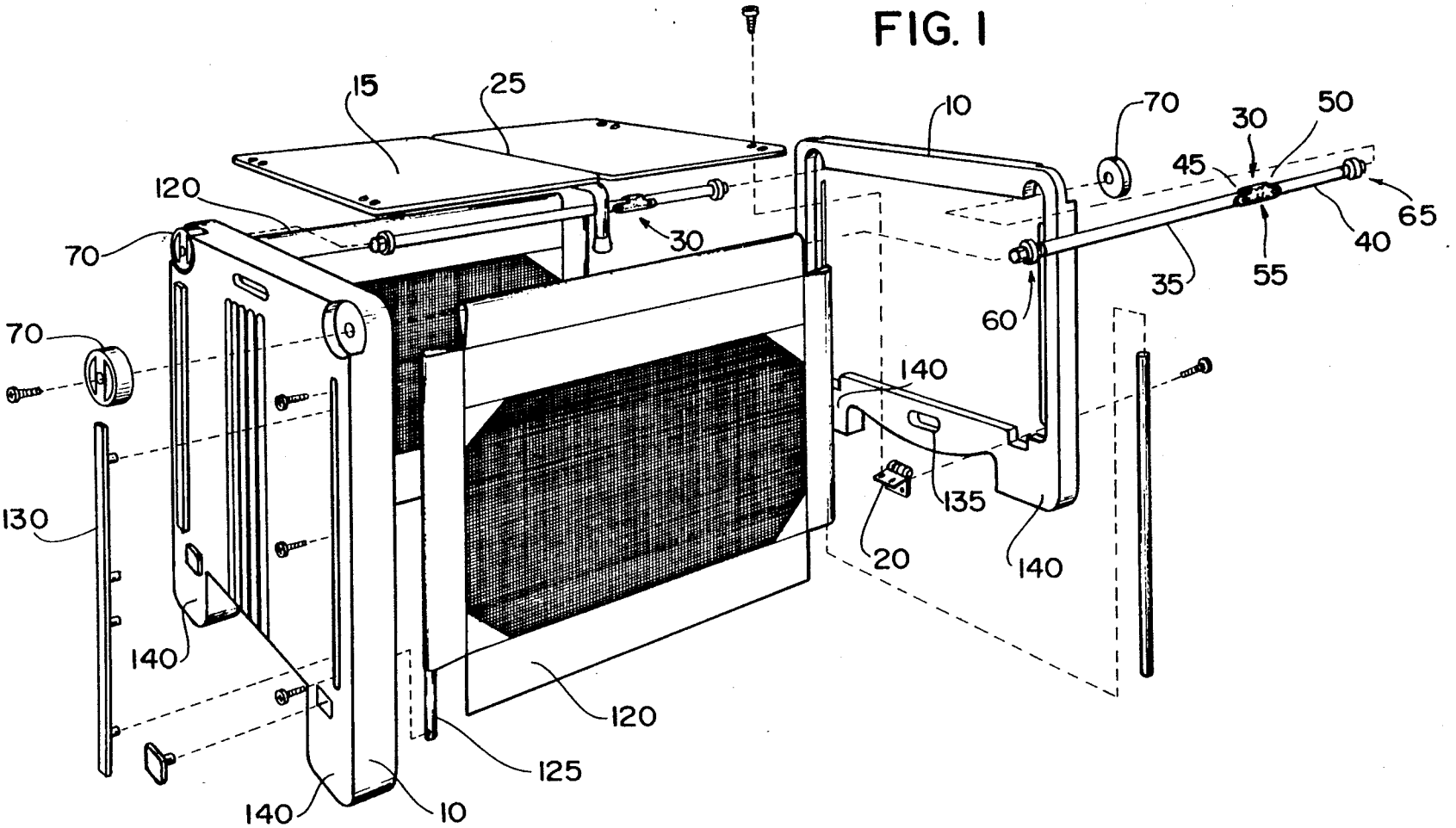
FIG. 1 is a perspective exploded view of a preferred embodiment of the present invention.
Figure 6:
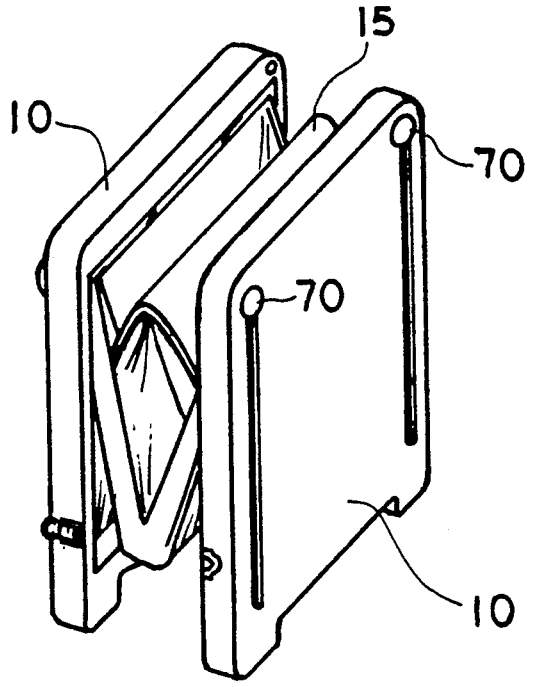
FIG. 6 is a perspective view of the FIG. 1 embodiment in a partially collapsed or folded state.
Figure 7:
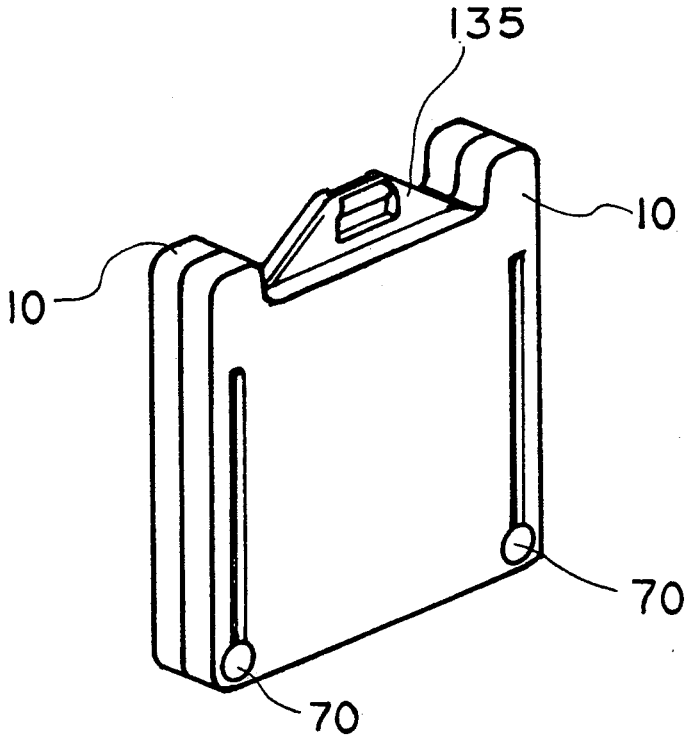
FIG. 7 is a perspective view of the FIG. 1 embodiment in a collapsed or folded state.

FIG. 1 is a perspective exploded view of an embodiment of the present invention. In FIG. 1, a pair of opposing end members 10 are deployed in spaced apart opposition. In FIG. 1 a base 15 is positioned between the opposing end members 10. In a preferred embodiment of the present invention, the base 15 is movably mounted to the opposing end members 15 using, for example, hinges 20. The base 15 has an articulated center portion 25 which folds up when the collapsible structure of the present invention is collapsed or folded as shown in FIGS. 6 and 7.

In FIG. 1, reference numeral 30 identifies a coupling member. The coupling member 35 is positioned between the opposing end members 10 and comprises an elongated member having first and second articulated portions or elongated members (35, 40). The elongated members or articulated portions (35, 40) each have first end portions 45 and 50 linked to each other via a linkage 55. Each of the elongated members (35, 40) has a second end portion (60, 65) respectively, selectively connectable to a corresponding one of the opposing end members 10. In a preferred embodiment of the present invention, the second end portions, (60, 65) are rotatably mounted within the opposing end members 10 and connected to a movable member 70.

Movement of the movable member 70 causes the coupling member 30 to move. For example, shown in FIG. 1, rotation of the movable member 70 causes rotation of the coupling member 30 so that the linkage 55 rotates with the elongated members 35 and 40. The coupling member 30 can therefore be moved between a deployed position and a collapsible position. Together, the coupling member 30 including the elongated members (35, 40), linkage 55 and second end portions (60, 65)

functions as a coupling means for rigidly connecting the opposing end members 10 in a first (i.e., deployed) state, and for movably connecting the opposing end members 10 in a second (i.e., collapsible) state. The following describes this function and operation with reference to FIGS. 2 and 3.

FIG. 2 is a side view of the coupling member 30 shown in FIG. 1 As shown in FIG. 2, each of the second end portions (60, 65) comprises a hinged joint that respectively rotate about axes 75 and 80. Since the structure of each of the hinge joints is the same, the following describes only one of the joints. Referring to FIG. 2, the hinge joint on the second end portion 60 comprises a female member 85 and a male member 90. FIG. 3 is a top view of the second end portion 60. As shown in FIG. 3, the male member 90 engages a forked portion of the female member 85. The members 85 and 90 are rotatably connected with, for example, a bolt or rivet at the axis 75. The movable member 70 is connected to a portion 87 of the female member 85. As shown, the portion 87 has a hexagon cross section. Any type of keyed connection can be used so long as movement of the movable member 70 causes the coupling member 30 to move between a deployed position and a collapsible position. Those skilled in the art will recognize that the movable connection between the coupling member 30 and the movable member 70 can be any type of articulated joint.

Rotation of the movable member 70, which is connected to the second end portion 60, causes the coupling member 30 to rotate about an axis 95. Rotation of the coupling member 30 about axis 95 causes the linkage 55 to move from the collapsible state illustrated in FIG. 2 to a deployed position wherein a strap member 100 is rotated 180° from the position shown in FIG. 2. In other words, the strap member 100 is moved to a top position when the coupling member 30 is in a deployed state.

The linkage 55 comprises the strap member 100 and a linkage 105. In the collapsible for foldable state shown in FIG. 2, applying a force to the linkage 105 causes the first end portions (40, 45) to respectively rotate about axes 110 and 115. For example, first end portion 45 rotates in a clockwise direction about the axis 110 and the first end portion 50 rotates in a counterclockwise direction about axis 115. As the coupling member 30 is collapsed or folded, the elongated members 35 and 40 respectively rotate about axes 75 and 80. Simultaneously, the base 10 folds upwardly to a position such as shown in FIG. 6; and the opposing end members 10 move towards each other; and encase the coupling member 30 and base 15 when the opposing end members 10 are juxtaposed as shown in FIG. 7.

Figure 5:
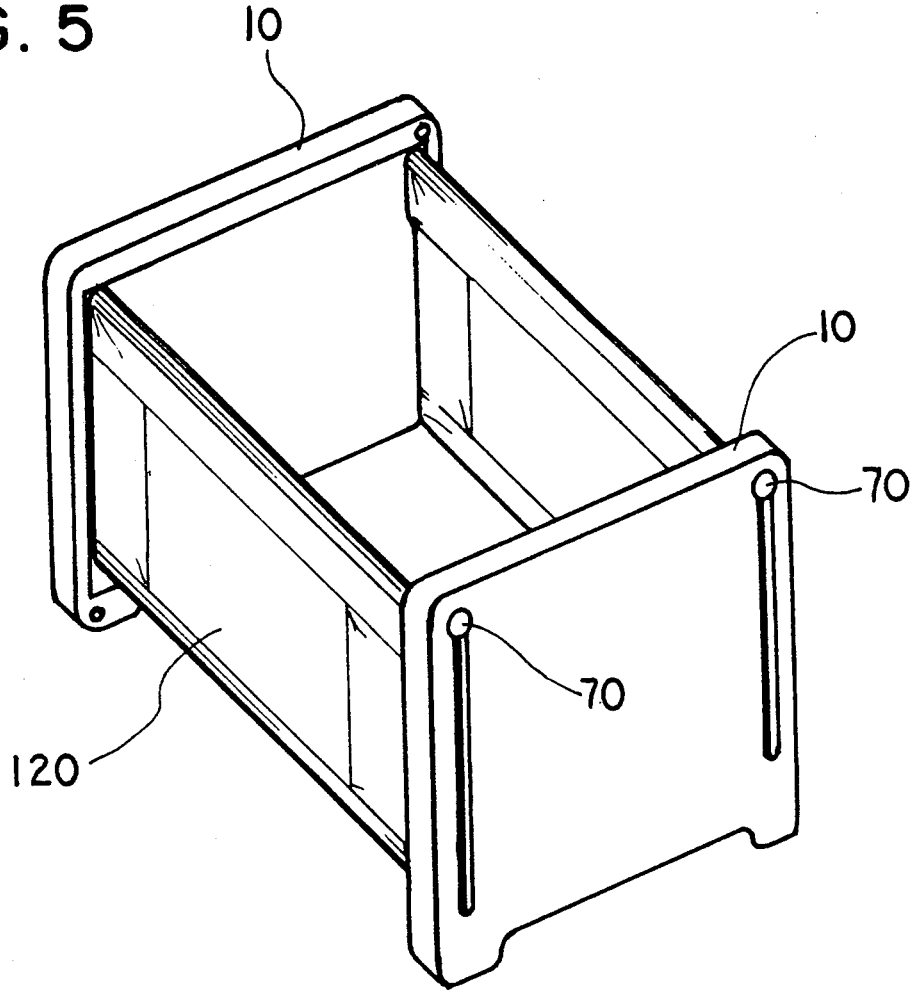
FIG. 5 is a perspective view of the FIG. 1 embodiment in a deployed position.

Referring to FIG. 1, side walls 120 are positioned between the opposing end members 10. The side walls 120 comprise a flexible material such a mesh shown in FIG. 1. In a preferred embodiment of the present invention, the side walls 120 are attached to corresponding end members 10 via a rod 125 and a member 130. Any type of connection between the sidewalls 120 and the opposing end members 10 can be used. It is preferable that the sidewalls be of a soft material and to be held taut between the opposing end members when the end members are in the deployed state. With the meshed material side walls 120 shown in FIG. 1, when the end members 10 are held in the deployed position, the side walls 120 are stretched between the opposing end members 10 as shown in FIGS. 1 and 5. When the end members are juxtaposed, the end members 10 encase the base 15, the coupling member 30 and the side walls 120 to form a package such as shown in FIG. 7.

Figure 8:
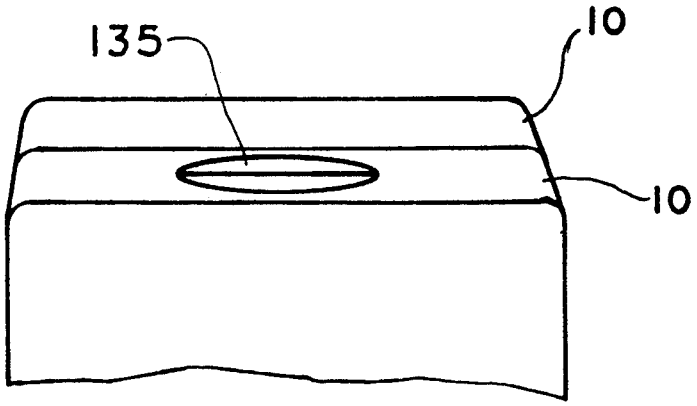
FIG. 8 is an alternative embodiment of a portion of the FIG. 1 embodiment.

As shown in FIG. 1, one of the end members 10 has an integral handle portion 135. Each of the end members also has integral leg portions 140. The handle portion 135 need not be formed as shown in FIG. 1 and can be integrally formed within one of the end members 10 as shown in FIG. 8 or be formed as a portion of each of the end members 10. In the FIG. 8 embodiment, the end members 10 do not have the leg members 140. Of course, the embodiment of FIG. 1 can be modified to include an integral handle portion such as shown in FIG. 8. Those skilled in the art will recognize that there are many ways to embody a handle portion that is integral with one or both of the opposing end members 10. The above embodiments are presented merely as examples.

Referring to FIG. 5, the collapsible structure of the present invention can be folded by rotating movable members 70 (FIG. 1) connected to the coupling members 30 so as to move the coupling members 30 from the deployed position to the collapsible or foldable position (shown in FIG. 2) as discussed above. When the coupling members 30 are in the collapsible position, pressure on the top portion of the coupling members 30 causes the coupling members to move towards the base. At the same time, slight upward pressure on the base causes the base 15 to move upwardly; and the opposing end members 10 move towards each other. An intermediate folded or collapsible state is shown in FIG. 6. When the structure is in the state shown in FIG. 6, applying pressure to the opposing end members causes them to be juxtaposed and to encase the base 15, side walls 120 and coupling members 30. FIG. 7 illustrates the collapsed or folded position of the collapsible structure of the present invention.

The above description of the present invention is not intended to limit the present invention to any particular embodiment. Instead, the scope of the present invention is defined by the following claims.

We claim:

1. A collapsible structure including:

an enclosure comprising a pair of rigid opposing end members;

a foldable base positioned between said end members;

a pair of flexible opposite side walls positioned between said end members; and a pair of cylindrical foldable support members, each being rotatable about a longitudinal axis between first and second positions and being disposed between the opposing end members and having two segments, each segment having a proximal end pivotally connected to a corresponding one of the pair of end members and a distal end pivotally coupled to the distal end of the other segment through a linkage, each said support member being rigid when rotated to the first position and foldable when rotated to the second position.

2. A collapsible structure according to claim 1, wherein each of the flexible opposite side walls is made of fabric.

* * * * *